United States Patent [19]

Huber

[11] Patent Number: 4,972,891

[45] Date of Patent: Nov. 27, 1990

[54] APPARATUS AND METHOD FOR SHAPING SHINGLES

[76] Inventor: Barry R. Huber, Rte. 4, Box 668, Lake City, Fla. 32055

[21] Appl. No.: 497,875

[22] Filed: Mar. 23, 1990

[51] Int. Cl.[5] ..... B27M 1/00

[52] U.S. Cl. ..... 144/380; 144/254; 144/256.3; 144/259; 144/381

[58] Field of Search ..... 144/254, 256.3, 256.4, 144/259, 269, 270, 271, 380, 381

[56] References Cited

U.S. PATENT DOCUMENTS

| | | | |
|---|---|---|---|
| 360,848 | 4/1887 | Bond | 144/381 |
| 369,638 | 9/1887 | Godfrey et al. | 144/269 |
| 1,346,161 | 7/1920 | Basquin | 144/380 |
| 2,017,037 | 10/1935 | Brown | 144/380 |
| 2,458,864 | 1/1949 | Lindsay | 144/256.3 |
| 3,030,711 | 4/1962 | Warring | 144/271 X |

*Primary Examiner*—W. Donald Bray

[57] ABSTRACT

A method and apparatus for shaping flat rectangular shingle blanks into curved shingles includes a heating chamber and shingle shaping device. The shingle shaping device is comprised of an elongate upwardly convex fixed shaping member and a plurality of hingedly mounted, downwardly concave movable shaping members. A plurality of shingle blanks are first steamed and then place on edge in side-by-side relation between the fixed shaping member and the movable shaping members. The movable shaping members are then moved into closed clamping relation with the fixed shaping member to clamp the shingle blanks into curved configuration for use with roofs having a thatched cottage appearance.

7 Claims, 2 Drawing Sheets

APPARATUS AND METHOD FOR SHAPING SHINGLES

FIELD OF THE INVENTION

This invention relates to an apparatus and method for shaping roofing shingles.

BACKGROUND OF THE INVENTION

Many prospective buyers of new homes now prefer their house to have the appearance of a thatched English cottage. In order to impart this appearance, the roofs of these homes must have a thatched appearance. These roofs must have gently rolling contours which are formed by curved or bent wood shingles.

Certain prior art devices have been developed for bending wood, such as those shown in U.S. Pat. No. 2,438,349, which shows an apparatus for bending corkwood or the like. In this patent, the wood is first compressed, then placed in a shaping mold, and water is thereafter added to cause the wood to expand into the shape of the mold.

In U.S. Pat. No. 360,848, wood panels are bent to form a part of a violin case by a mold comprised of metal clamps, which engage a flat end and adjacent edge portions of a wooden blank. The central portion of the panel is engaged between an elastic strap and a central mold element having a convex upper surface.

U.S. Pat. Nos. 1,346,161 and 2,017,037 also disclose methods and devices for bending wood panels. However, none of these patents disclose the method of employing cooperating concavo-convex shaping members for shaping continuously curved roofing shingles.

SUMMARY OF THE INVENTION

An object of this invention is to provide a novel and improved method and apparatus for shaping wooden roofing shingles.

A more specific object of this invention is to provide an apparatus comprised of concavo-convex clamping members for clamping and shaping steamed wooden shingle blanks into continuously curved shingles. In carrying out this invention, steamed unshaped shingle blanks are positioned upon a fixed clamping member having an upwardly convex clamping surface. The fixed clamping member can accommodate a plurality of shingle blanks arranged in side-by-side relation. A plurality of flexible movable clamping members, each having a concave clamping surface, engage and clamp the shingle blanks against the fixed clamping member after the shingle blanks have been steamed. A series of shingles are simultaneously clamped and retained in the shaping device.

FIGURES OF THE DRAWINGS

FIG. 1 is a perspective view of the apparatus illustrating the heating chamber structure and one embodiment of the shingle bending device;

FIG. 1*a* is a side elevational view of the shingle bending device illusted in FIG. 1, illustrating the same in an open position for accommodating a shingle blank to be bent;

FIG. 1*b* is a side elevational view of the shingle bending device illustrated in FIG. 1, but illustrating the same in a closed position;

DESCRIPTION OF THE PREFERRED EMBODIMENT

Figure 1:
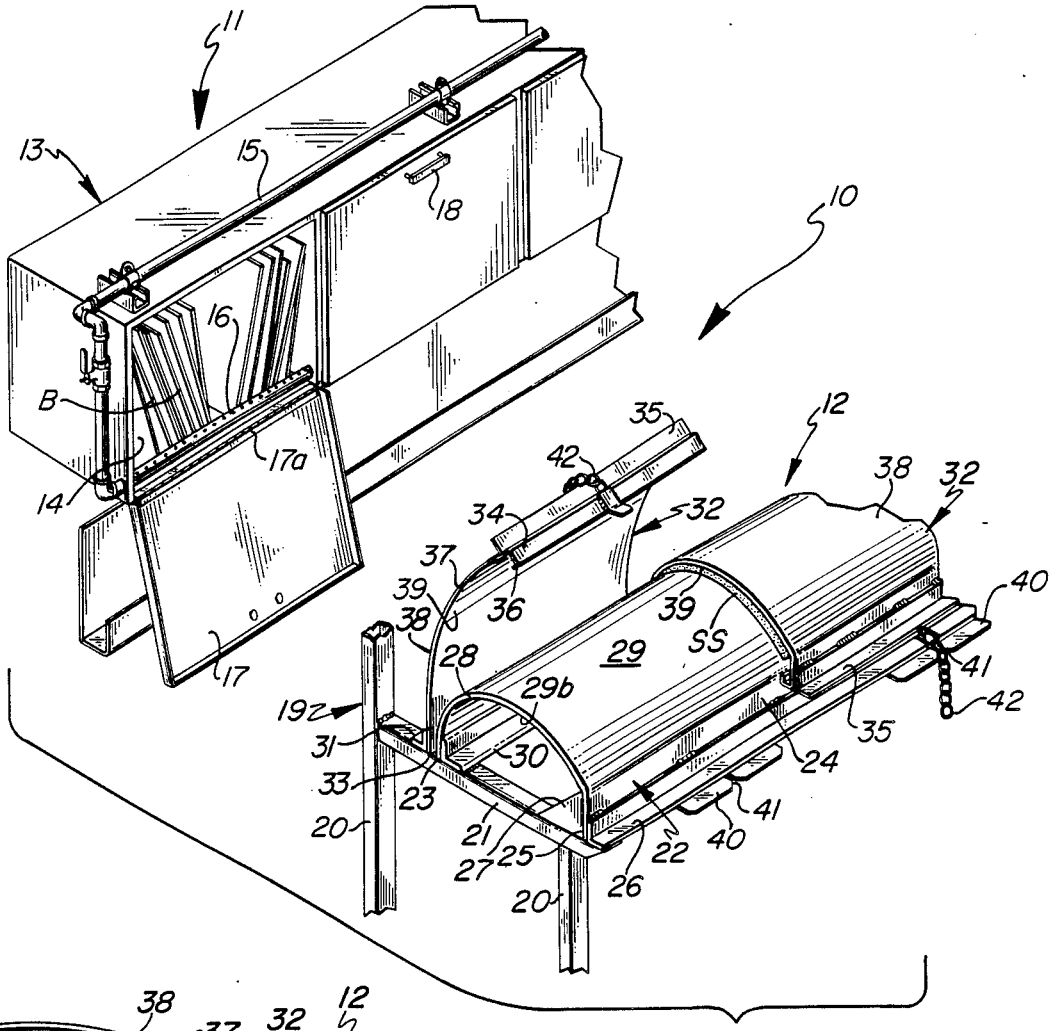
Figure 1A:
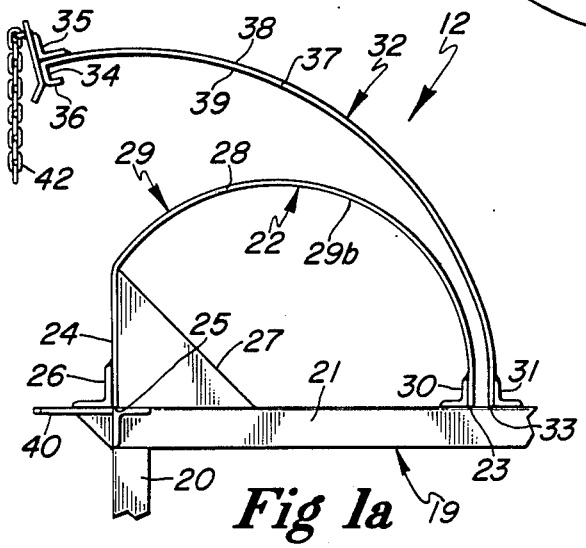

Referring now to the drawings and, more specifically, to FIGS. 1 and 1*a*, it will be seen that one embodiment of the novel shingle shaping apparatus, designated generally by the reference numeral 10, is thereshown. This apparatus includes a heating chamber structure 11 and a shingle bending device 12. The heating chamber structure 11 is comprised of a generally rectangular-shaped elongate housing 13 formed of a suitable metal and having an interior or chamber 14 which is of a size to accommodate a plurality of shingle blanks B therein. The heating chamber structure 11 includes an elongate pipe 15, which is connected to a source of steam under pressure, and which is connected in communicating relation to an apertured steam emitting cylindrical element 13 positioned within the housing chamber 14. Steam is emitted through the apertures in the cylindrical element 17 to permit steaming of the shingle blanks B in the chamber 14.

In the embodiment shown, the housing 13 is provided with a plurality of similar doors 17, which are hingedly connected to the housing by means of hinges 17*a*. Each door 17 is provided with a handle 18 to facilitate opening and closing the doors. With this arrangement, the doors 17 permit access to different portions of the chamber 14 to permit shingles to be placed in the chamber and to be removed therefrom. Typically, the shingle blanks are steamed in the chambers for a period within the range of about 15 to 30 minutes.

The shingle shaping device 12 includes a support frame 19 comprised of vertical frame members 20 and horizontal frame members 21. An elongate upwardly convex fixed shaping member 22 formed of rigid metallic material is mounted on the horizontal frame members 21 and extends throughout the length of the shingle shaping device 12. The fixed shaping member 22 has an elongate rear longitudinal edge 23, which is positioned between an elongate angle iron 30 and an elongate angle iron 31, each of these angle irons being rigidly secured to longitudinal frame members 21. In the embodiment shown, the rear longitudinal edge 23 is welded to the angle iron 30 and extends upwardly and forwardly therefrom.

The fixed shaping member 22 also includes a substantially planar front vertical portion 24, which terminates in a front longitudinal edge 25, the latter being rigidly secured to an angle iron 26. The angle iron 26 is rigidly affixed to the horizontal frame members 21 and suitable triangular gussets engage the horizontal frame members 21 and the lower surface 29*b* of the fixed shaping member 22 at spaced longitudinal points along the length of the latter. The fixed shaping member 22 has end edges 28 and presents a convex curved upper clamping surface 29, aganst which a shingle blank B is clamped. The fixed shaping member 22 has a length dimension of a magnitude to thereby permit several shingle blanks B thereon in side-by-side relation.

The shingle shaping device 12 also includes a plurality of movable shaping members 32, each having a rear longitudinal edge 33 and a front longitudinal edge 34. The rear longitudinal edge 33 of each movable shaping member 32 is rigidly secured to the angle iron 31, and an angle iron 35 is rigidly affixed to the upper surface of each movable shaping member to impart rigidity thereto. It will also be noted that the front edge portion of the movable member 32 is bent downwardly and inwardly at 34 and inwardly at 36. In this regard, the movable shaping member 32 is somewhat flexible so that the rigid connection between the rear longitudinal edge thereof and the angle iron 31 actually constitutes the hinge connection. It is also pointed out that the rear longitudinal edge 33 of the movable shaping member 32 is spaced from the rear longitudinal edge 23 of the fixed shaping member 22 a distance sufficient to accommodate the edge portion of the shingle blank B therein.

The movable shaping member 32 also has end edges 37, one of which is disposed in the same vertical plane as the end edge 28 of the fixed shaping member 22. Each movable shaping member 32 has an upper convex surface 38 and a lower concave clamping surface 39, which cooperates with the upper convex clamping surface 29 of the fixed shaping member to clamp a shingle to be shaped therebetween. In the embodiment shown, a plurality of substantially flat locking plates 40 are secured to the angle iron 26, and each plate 40 has a locking notch 41 therein.

Each movable shaping member 32 is provided with a locking chain 42 which has one end secured thereto, and which depends therefrom. The chain is centrally located with respect to the associated movable shaping member and is located so that the chain may engage in the locking notch 41 to releasably lock the movable shaping member 32 in a closed locking position with respect to the fixed shaping member 22.

Figure 1B:
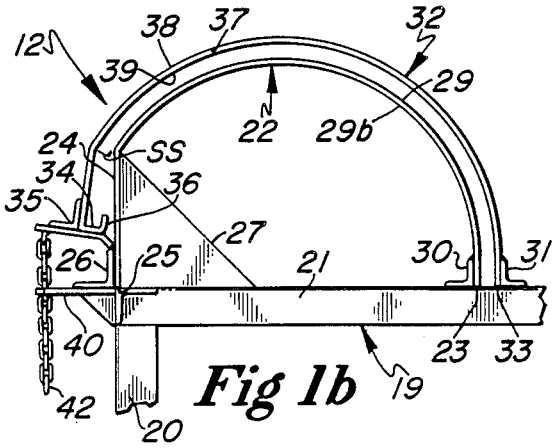
Figure 5:
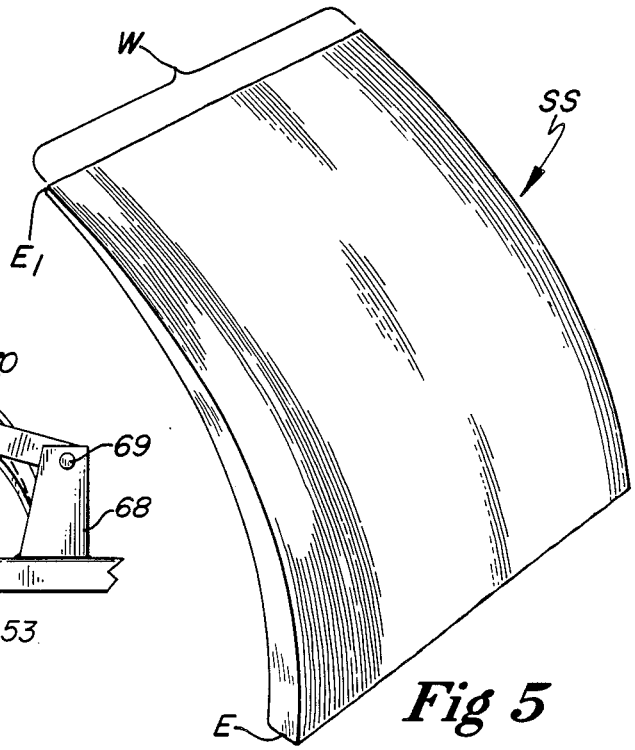
FIG. 5 is a perspective view of a shingle shaped with the shaping apparatus of the present invention.

Referring now to FIGS. 1–1*b* and FIG. 5, it will be seen that the shingle blanks B are first steamed in the heating chamber structure 11 for a sufficient time to make the shingles somewhat pliable. The shingle blanks are then removed from the heating chamber structure and several of the shingle blanks are placed upon the fixed shaping member 54 in side-by-side relation. The shingle blanks are placed in the molding space so blanks are bent against the grain. The width W of the shingle blanks varies and the shingle blanks are also tapered from edge E to the other edge E1. The rear edge portion E of each shingle blank B is placed in the space defined between the rear longitudinal edges of the fixed and movable shaping members. Thereafter, the movable shaping members, which are in the open position, are pulled downwardly by a user until the shingle blanks are compressed against the fixed shaping member 22. The locking chain 42 for each movable shaping member is locked to its associated locking plate 40. The somewhat flexible properties of the movable shaping member allow the latter to flex slightly during this closing operation. Each clamped shingle blank will be allowed to remain in clamped condition until the shingle blanks dry so that they retain their new shape. Under ordinary circumstances, the shingle blanks are clamped for a period within the range of 15 to 30 minutes. During this clamping and shaping operation, the rear edges of the shingle blanks are positioned within the space between the rear longitudinal edges of the fixed and movable shaping members. The first edge of each shingle blank is located at the juncture between the curved surface 29 and the front planar surface 24 of each fixed shaping member.

Figure 2:
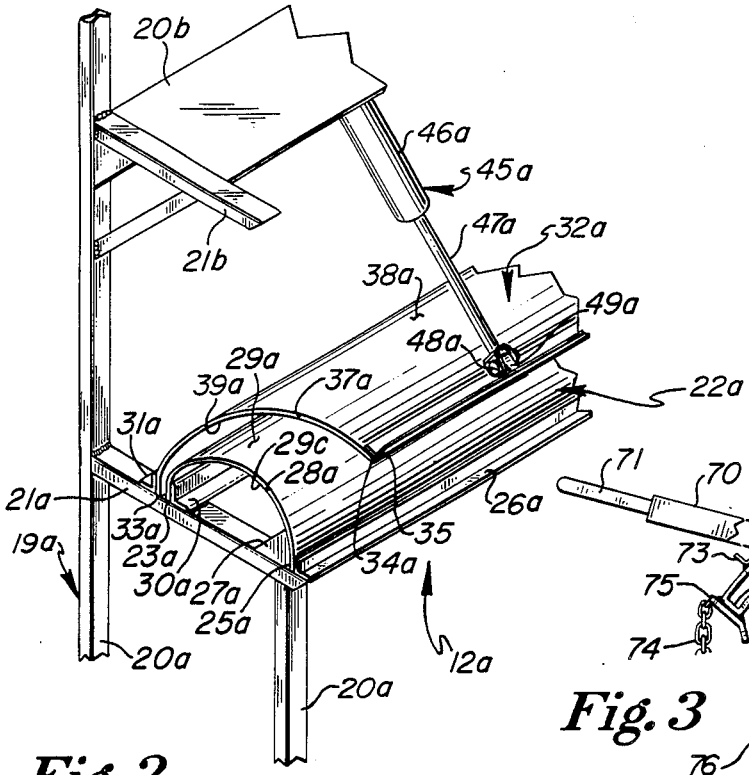
FIG. 2 is a fragmentary perspective view of a modified form of the shingle bending device.

Referring now to FIG. 2, it will be seen that a slightly modified embodiment of the shingle shaping device, designated generally by the reference numeral 12*a*, is thereshown. The shingle shaping device 12*a* also includes a support frame 19*a* comprised of vertical frame members 20*a* and lower horizontal frame members 21*a* and upper horizontal frame members 21*b*. The support frame 19*a* is also provided with an upper horizontal mounting plate 20*b*, which is secured to the upper horizontal frame members 21*b*.

The shingle shaping device 12 also includes an upwardly convex fixed shaping member 22*a* having its rear longitudinal edge 23*a* rigidly secured to an angle iron 30*a*. An angle iron 31*a* is positioned adjacent and in slightly spaced relation with respect to the angle iron 30*a*. The fixed shaping member 22 also has a front longitudinal edge 25*a*, which is rigidly secured to an angle iron 26*a* that extends longitudinally of the shingle shaping device 12*a*. It will be noted that the angle irons 26*a*, 30*a*, and 31*a* are all disposed in substantially parallel relationship with respect to each other in the manner of the embodiment of FIG. 1.

Longitudinally spaced apart generally triangular gussets 27*a* are rigidly secured to the lower surface 28*a* of the fixed shaping member and to the lower horizontal frame members 21*a*. It will be noted that the fixed shaping member 22*a* does not include a planar front vertical portion in the manner of the embodiment of FIG. 1, but is uniformly curved from the front longitudinal edge to the rear longitudinal edge thereof. The fixed shaping member 22*a* also has an upwardly convex curved clamping surface 29*a*.

The shingle shaping device 12*a* also includes a plurality of movable shaping members 32*a*, each having its rear longitudinal edge 33*a* secured to the angle iron 31*a*, as by spot welding or the like. The rear edges of the fixed and movable shaping members are spaced apart to accommodate the edge portions of shingle blanks therebetween. Each movable shaping member 32*a* has a front longitudinal edge portion 34*a* rigidly affixed to an elongate angle iron 35*a*. Each movable shaping member 32*a* also has opposed end edges 37*a*, and presents an upper convex surface 38 and a lower concave clamping surface 39*a*.

Means are provided for shifting each movable clamping member 32*a* between open and closed positions and for retaining each movable clamping member in a closed position. This means includes a plurality of double-acting hydraulic units 45*a*, each including a cylinder 46 pivotally attached to the upper plate 20*b* and extending therefrom. The cylinder 46 is provided with a movable piston therein, which is connected to a piston rod 47*a* having its free end pivotally connected by a pivot 48*a* to a bracket 49*a* secured to the angle iron 35*a*. It will be seen that, when the piston rod 47*a* is extended and retracted, the movable clamping member 32*a* will be shifted between the open and closed positions. The shaping procedure is substantially identical to that described with respect to the embodiment of FIG. 1.

Figure 3:
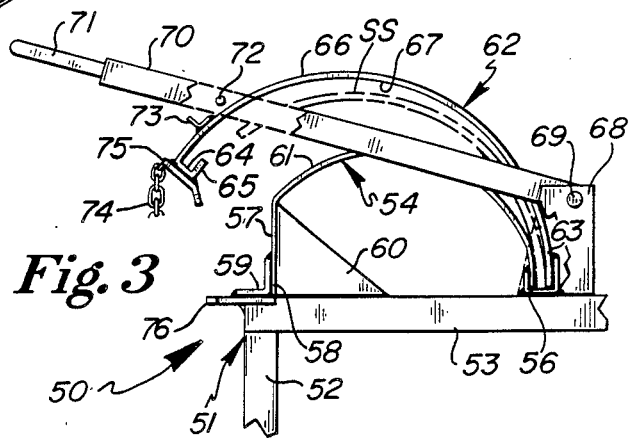
FIG. 3 is a side elevational view of a further modified form of the shingle bending device.
Figure 4:
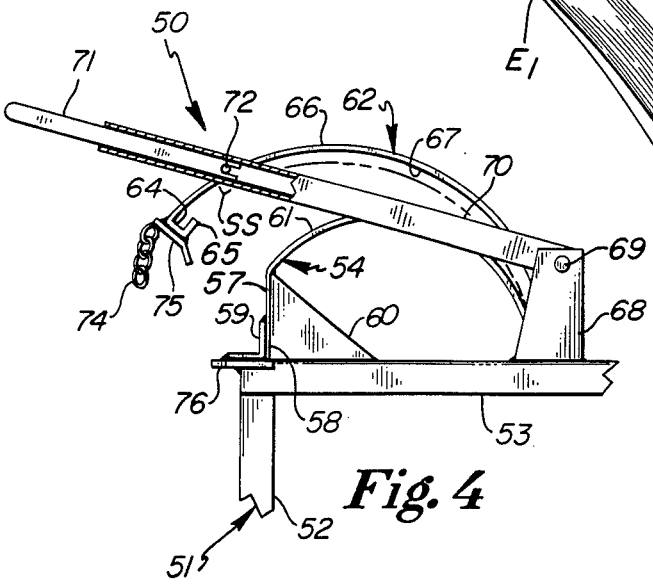
FIG. 4 is a side elevational view of the shingle bending device illustrated in FIG. 3, with certain parts thereof broken away for clarity.

Referring now to FIGS. 3 and 4, it will be seen that a different embodiment of the novel shingle shaping device, designated generally by the reference numeral 50, is thereshown. The shingle shaping device 50 includes a support frame 51 having vertical frame members 52 and horizontal frame members 53 in the manner of the embodiment of FIG. 1. An upwardly convex fixed shaping member 54 is mounted on the horizontal frame members 53 and includes a rear longitudinal edge 55 secured within a channel-shaped member 56 mounted on the horizontal frame members 53. The fixed shaping member 54 is provided with a front planar vertical portion 57, which terminates in a front longitudinal edge 58, the latter being rigidly secured to an angle iron 59. The angle iron 59 is mounted on the horizontal frame members 53 and a plurality of gussets 60 are rigidly affixed to the horizontal frame members and to the planar vertical portion 57 along the length of the fixed shaping member 54. The fixed shaping member 54 has a convex upper clamping surface 61, which is substantially identical in configuration to that illustrated in the embodiment of FIG. 1.

The shingle shaping device 50 is also provided with a plurality of movable clamping members 62, each having its longitudinal rear edge 63 rigidly affixed in the channel-shaped member 56. Again, it will be noted that the rear edges of the fixed and movable clamping members are spaced apart a distance sufficient for accommodating edge portions of shingle blanks therebetween. The movable clamping members 62 are somewhat flexible and each has an inwardly bent front edge portion 64, which terminates in a lip 65 bent at substantially right angles to the bent front edge portion. The movable clamping member 62 has a convex upper surface 66 and a concave lower clamping surface 67. The rear longitudinal edge of each movable clamping member 62 is hingedly connected to the channel-shaped member 54 for movement between open and closed positions.

Means are provided for shifting the movable clamping member between open and closed positions, and this means includes a pair of brackets 68, which are rigidly affixed to the horizontal frame members 53 and project upwardly therefrom adjacent the channel-shaped member 56. An elongate handle 70 is pivotally connected to the brackets 68 by means of a pivot 69. The handle 70 is of hollow construction and is provided with a telescoping portion 71. An elongate transverse rod 72 extends through the handle 70 and is engaged by the notched forward end of the telescoping handle portion 71, as best seen in FIG. 4. The rod 72 extends outwardly of the handle 70 in overlying relation to the movable clamping members 62. Each movable clamping member is also provided with an angle iron engaging member 73, which is secured to the upper convex surface 66 thereof. When movable clamping members 62 are moved to the closed position, the rod 72 will engage the angle iron members 73 to urge the clamping members to the closed position.

Locking means are provided for releasbly locking the movable clamping members in the closed position, and this means includes, for each movable clamping member, an elongate locking chain 74 having one end thereof reasonalby secured to a bracket 75, the latter being secured to the bent front end edge portion of the movable clamping member adjacent the central portion of the latter. The shingle shaping device 50 is also provided with a plurality of locking plates 76, each having a locking notch therein for accommodating the chain 74 in the manner of the embodiment of FIG. 1, to permit the movable clamping member to be releasably locked in a closed position.

It is pointed out that shaping devices having differently configured shaping members may also be employed to produce concavo-convex roofing shingles of somewhat different configurations.

From the foregoing description, it will be seen that I have provided a novel and improved apparatus and method for shaping flat rectangular roofing shingle blanks into aesthetically appealing curved configurations for use with homes having the thatched English cottage appearance.

It will also be seen that my novel method and apparatus for shaping roofing shingles is effective for shaping rectangular roofing shingle blanks into curved roofing shingles in a more inexpensive and efficient manner than any heretofore known comparable system.

What is claimed is:

1. An appratus for shaping substantially flat rectangular roofing shingle blanks into roofing shingles having a curved configuration, comprising:

a heating structure for simultaneously steam heating a plurality of substantially flat rectangular roofing shingle blanks, a support frame, a shaping device including an elongate upwardly convex fixed shaping member mounted on said support frame and being of a length to accommodate a plurality of the steamed shingle blanks thereon in side-by-side relation, said fixed shaping member having front and rear longitudinal edges, a plurality of similar movable shaping members, each having front and rear longitudinal edges, each movable shaping member hacing a rear longitudinal edge portion secured to said support frame to hingedly connect each movable shaping member to the support frame for movement between open and shut positions, said movable shaping members being disposed in side-by-side relation and each having a convex upper surface and a convex lower clamping surface, the latter engaging and clamping the shingle blank against the convex fixed shaping member when the movable shaping member is in the closed position, and means engaging said movable shaping member and said support frame for retaining said movable shaping member in the closed position.

2. The apparatus as defined in claim 1 wherein the respective rear longitudinal edge portions of said fixed shaping member and said movable shaping member are disposed in close proximal spaced relation with respect to each other, the spacing between the rear edge portion of each movable shaping member and each fixed shaping member being of a magnitude to accommodate the edge portion of a shingle blank therein whereby, when each movable shaping member is moved to the closed position, a shingle blank will be clamped against the convex fixed shaping member.

3. The apparatus as defined in claim 2 wherein said fixed shaping member includes a curved portion and a vertical front planar portion, said curved portion extending from the rear longitudinal edge of said fixed shaping member to said front planar portion thereof, each movable shaping member cooperating with said fixed shaping member ot clamp a shingle blank against the curved portion only of said fixed shaping member.

4. The apparatus as defined in claim 1 wherein said retaining means for each movable shaping member includes a flexible chain on each movable shaping member and a notched locking plate on said support frame.

5. The apparatus as defined in claim 1 wherein said retaining means for each movable shaping member includes an extensible and retractable piston and cylinder unit connected to the support frame and to a movable shaping member, said piston and cylinder unit, when extended, moving and retaining the associated movable shaping member in the closed position, and, when retracted, moving and retaining the associated movable shaping member to the open position.

6. The apparatus as defined in claim 1 and an elongate handle pivotally connected to said support frame, means on said handle being engageable with said movable support members for shifting the latter from the open to the closed position.

7. A method of shaping substantially flat rectangular shingle blanks into curved shingles for use with thatched-appearing roofs of homes, buildings, and the like, comprising the steps of:

placing a plurality of flat rectangular shingle blanks in a heating medium and subjecting the shingle blanks to steam heating for a predetermined period of time, removing the heated shingle blanks from the heating medium and placing a plurality of the steam-heated blanks in side-by-side relation upon an upwardly convex fixed clamping medium and below downwardly concave movable clamping media, each shingle blank being positioned upon an edge thereof between the fixed clamping medium and the movable clamping media and extending upwardly and forwardly therefrom, and moving the movable clamping media downwardly towards said fixed clamping medium to progressively clamp the shingle blanks between the fixed clamping medium and the movable clamping media, and retaining the shingle blanks in clamped relation between said fixed clamping medium and the movable clamping media for a predetermined period of time to permanently reshape the shingle blanks into curved configuration.

* * * * *